United States Patent [19]

Popkin

[11] 4,136,414

[45] Jan. 30, 1979

[54] KNOCKDOWN BOAT WITH INFLATABLE HULL

[76] Inventor: John R. Popkin, Apt. 303, 739 S. Normandie, Los Angeles, Calif. 90005

[21] Appl. No.: 814,229

[22] Filed: Jul. 11, 1977

[51] Int. Cl.[2] ..... B63B 7/00

[52] U.S. Cl. ..... 9/2 A; 114/61; 114/39

[58] Field of Search ..... 9/2 R, 2 C, 2 F, 2 S, 9/2 A, 6 R, 310 F, 11 R, 11 A, 13; 114/39, 61, 123

[56] References Cited

U.S. PATENT DOCUMENTS

| | | | |
|---|---|---|---|
| 3,056,980 | 10/1962 | Holladay | 9/310 F |
| 3,304,899 | 2/1967 | Weatherly | 114/123 |
| 3,473,502 | 10/1969 | Wittkamp | 9/2 A |
| 3,812,805 | 5/1974 | Forssell | 9/2 A |
| 3,841,251 | 10/1974 | Larson | 114/39 |
| 3,902,443 | 9/1975 | McDougall | 114/123 |

*Primary Examiner*—Trygve M. Blix
*Assistant Examiner*—D. W. Keen
*Attorney, Agent, or Firm*—Whann & McManigal

[57] ABSTRACT

A high performance portable knockdown boat structure having one or more unique inflatable hull structures in the form of a relatively low pressure envelope which tapers from its mid-length to its opposite ends, and is provided with a sectionalized light weight reinforcing tubular member which can be inserted endwise into a longitudinally extending surface sleeve. The reinforcing member is easily inserted into the sleeve when the envelope is deflated, and upon inflation of the envelope will be retained and anchored against removal. The unique envelope may be readily embodied in boats of the single hull type with or without an outrigger, as well as in boats having more than one hull, and particularly to provide a unique, lightweight, high performance catamaran.

As a catamaran, a pair of the inflatable envelopes are releasably interconnected by means of forward, mid and aft disconnectible bridging frames to a rigid longitudinal frame structure positioned between the inflatable envelopes, this rigid frame being fitted with the boat mast and rudder.

17 Claims, 6 Drawing Figures

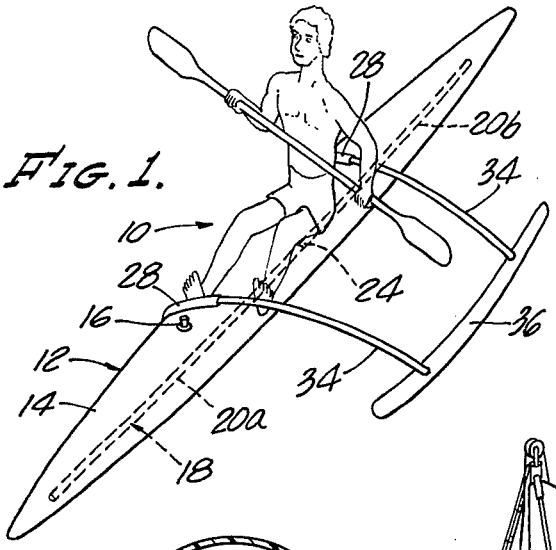
FIG. 1.
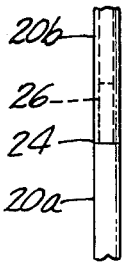
FIG. 2.
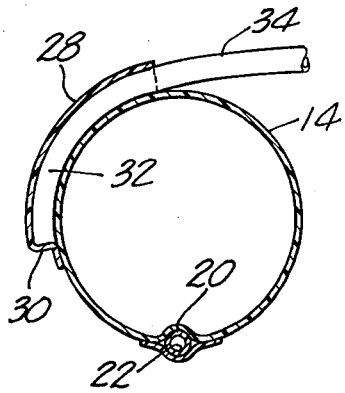
FIG. 3.
FIG. 6.
FIG. 5.
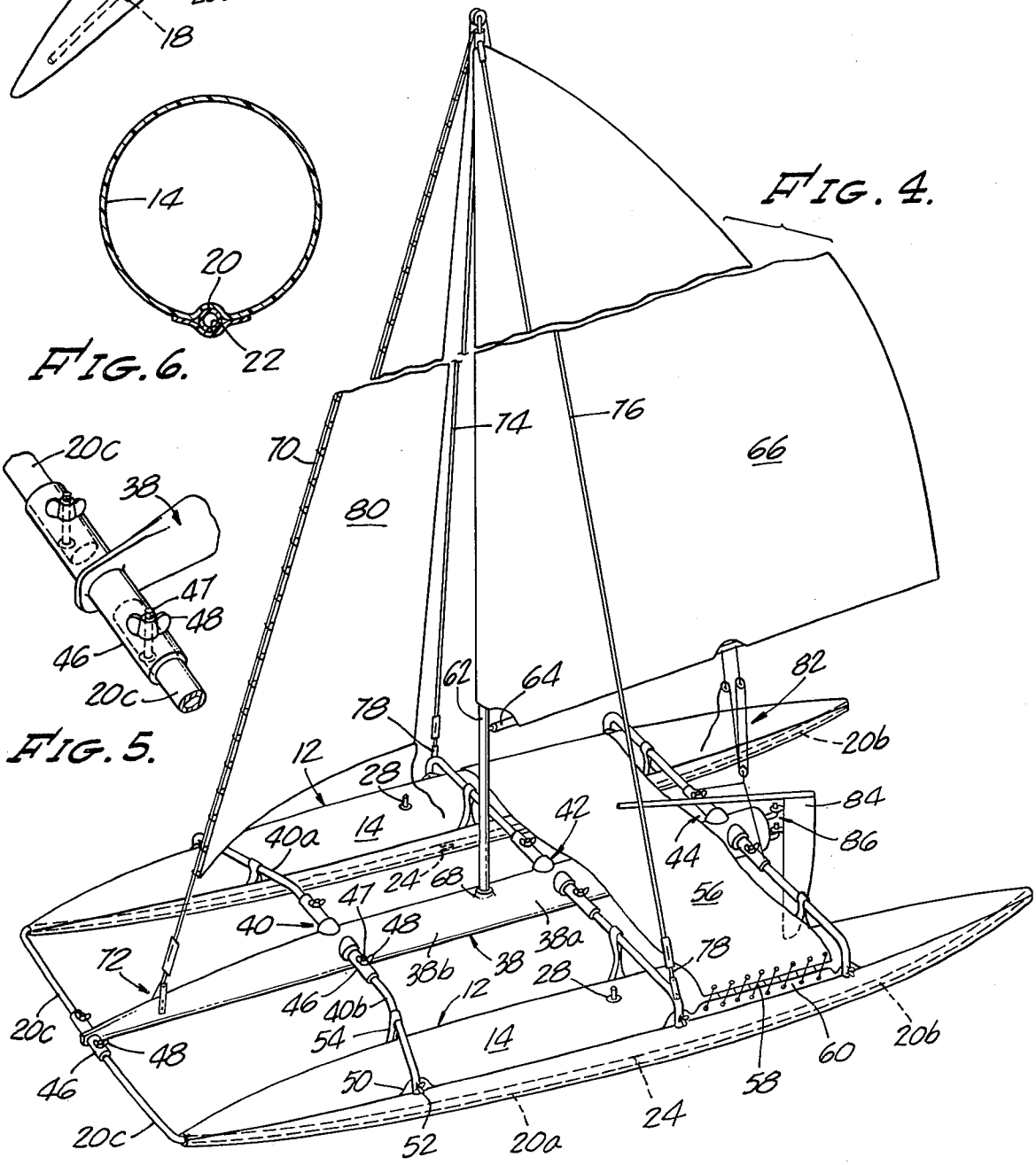
FIG. 4.

KNOCKDOWN BOAT WITH INFLATABLE HULL

BACKGROUND OF THE INVENTION

The present invention relates generally to the field of water-borne vehicles, and is more particularly concerned with boat structures of the portable knockdown type.

Heretofore, knockdown boats and boats with inflatable hulls have not been compatible with the shape required to provide a boat structure capable of high performance, as for example, in a catamaran, which requires a long and narrow configuration. Experiments have indicated that even the use of high inflation pressures of the order of two to three pounds per square inch for a conventional envelope structure does not produce the desired results, and requires expensive fabrication techniques.

In the present invention it has been found that the above difficulties can be overcome by utilizing an inflatable low pressure envelope that can be readily conformed to the required shape for high performance operation. The necessary rigidity may be obtained through the use of light weight, high-tempered aluminum tubing members which are held within a fabric surface sleeve of the envelope and extend between its ends. The tubing members are longitudinally curved to conform to the tapered ends of the envelope so that, when the envelope is inflated, the tubing members will be automatically retained in a proper position.

In the catamaran embodiment, the two hulls formed by the inflated envelopes are bridgingly retained in operative positions on the opposite sides of a central elongate frame member of fiberglass by means of forward, mid and aft tubular bridging frames having their outer ends connected to the hull envelopes.

Each envelope preferably has a fore and aft tubular rigidifying member, and these tubular members are arranged so that they will have their adjacent ends in abutting relation at approximately the mid-length of the envelope. The forward tubular members are laterally extended at the forward ends of the envelopes in a direction towards each other, and connected to the forward end of the central elongate frame member to provide a rigid frame structure. The mast and rudder are carried by the central frame member.

By utilizing the features of construction according to the present invention, a practical catamaran embodiment would have an approximate length of 15', a beam of 5'2", sail area of 100 sq. ft., maximum hull diameter of 15", provide for a crew weight of 275 lbs., and have a total assembled weight of approximately 55 lbs. In its knockdown condition, the boat collapses into a portable package of approximately 12.5' × 2.5'.

SUMMARY OF THE INVENTION

It is one object of the herein described invention to provide a knockdown water-borne vehicle of unique simplified construction, which is of light weight, easily assembled and of a design such that it will in use be capable of high performance operations.

A further object of the invention is to provide a knockdown type catamaran boat having hulls formed by low pressure inflatable envelopes with tapered ends to give high performance characteristics, and which are longitudinally rigidified by tubular members extending between the ends of the envelope, these members being retained in longitudinally extending sleeves formed on the envelope surface.

Another object is to provide a high performance catarmaran of the knockdown type which utilizes a pair of inflatable hulls disconnectedly supported on opposite sides of a central fiberglass frame structure by means of forward, mid and aft frame structures.

Further objects and advantages of the invention will be brought out in the following part of the specification, wherein detailed description is for the purpose of fully disclosing several embodiments of the invention without placing limitations thereon.

BRIEF DESCRIPTION OF THE DRAWINGS

Referring to the accompanying drawings, which are for illustrative purposes only:

FIG. 1 is a perspective view of a simplified water-borne vehicle, which embodies a hull structure according to the present invention;

FIG. 2 is an enlarged fragmentary view, illustrating the abutting end relationship of the envelope rigidifying tubular members;

FIG. 3 is an enlarged transverse sectional view taken through the inflatable envelope of the hull of the boat shown in FIG. 1, and showing the manner of connecting the end of a bridging member thereto;

FIG. 4 is a perspective view of a catamaran constructed according to the present invention;

FIG. 5 is an enlarged perspective structural detail view of the interconnection of the forward ends of the rigidifying tubular member of the inflatable envelopes with the forward end the central frame structure; and FIG. 6 is a transverse sectional view taken through the inflated envelope of one of the hulls, and showing the details of the longitudinally extending sleeve for receiving a regidifying longitudinally extending tubular member therein.

DESCRIPTION OF THE SEVERAL EMBODIMENTS

Referring more specifically to the drawings, for illustrative purposes, the invention is illustrated in FIG. 1 as being embodied in a boat structure 10 of the single hull type, and as more specifically embodied in a hull equipped with an outrigger.

The hull, as generally indicated at 12, comprises an elongated tubular envelope of a suitable vinyl-coated fabric or other appropriate material. The envelope is of transverse circular configuration, and is fabricated to have its maximum diameter at its mid-length. From this point, the envelope is gradually reduced in cross-section by a gentle curved taper towards each end in order to provide the hull with a high performance configuration, when the envelope is in inflated. A suitable inflation valve 16 is appropriately located in an upper surface portion of the envelope for use in inflating and deflating the envelope.

The envelope is designed for low pressure inflation in the order of one pound per square inch. It will be readily apparent that this low pressure is not sufficient in itself to provide the required longitudinal rigidity to permit its use as a boat hull. The required rigidity is accomplished by providing an elongate tubular means 18 which extends along the surface of the envelope between its ends. For this purpose, a high-tempered light weight aluminum tube 20 is used, the tube being separated into fore and aft sections **20*a* and 20*b***. The tube is contained within a longitudinally extending sleeve 22 which is formed on the surface of the envelope. In FIG. 3, the sleeve 22 is shown as being at the bottom periphery of the envelope. It is to be understood, however, that the sleeve does not have to be necessarily located in this position, but may, if desired, be positioned so as to extend along the top of the envelope. The tube sections 20*a* and 20*b* are of an appropriate length so that their innermost ends will be in abutting relation, to form a joint as indicated by the numeral 24. As shown in FIG. 2, the adjacent ends of the tube sections may be arranged to provide a slip-joint, in which an end extension 26 of reduced diameter on one of the sections will extend into the tubular end of the other section. The tube sections 20*a* and 20*b* are longitudinally curved between their ends so as to appropriately conform to the tapering end configurations of the envelope, when the envelope is inflated. As thus arranged, the tube sections will be automatically retained in a proper anchored position within the sleeve 22, when the envelope is inflated. Upon deflation of the envelope, the tube sections may be removed to facilitate their being transported with the rest of the boat in a knockdown condition.

It is to be understood that the hull structure as thus far described may in itself be utilized as a water-borne vehicle. However, if it is desired to utilize the hull structure with a connected outrigger, this is accomplished by modifying the envelope structure as illustrated in FIGS. 1 and 3. For this purpose, the envelope is provided with fore and aft arcuate sleeves 28 which are positioned respectively fore and aft of the mid-length of the envelope. The sleeve 28 is preferably closed at its lowermost end, as indicated at 30. The other end of the sleeve is open and is positioned at the top perimeter of the inflated envelope for receiving a curved end portion 32 of a bridging or spar member 34 having its outermost end connected with a rigid outrigger spar or frame member 36 which extends in generally parallel relationship to the hull 12.

In the catamaran embodiment as shown in FIG. 4, a pair of hulls 12 are appropriately positioned on opposite sides of and connected to a main longitudinally extending rigid frame structure 38. This frame structure is preferably constructed from a suitable material such as fiberglass and is preferably of less maximum diameter than the envelopes of the hulls, and may also be of less length. Preferably, the frame structure 38 is fabricated to provide an aft section 38*a* of substantially uniform diameter, and which extends from substantially the mid-length point to the aft end. A forward section 38*b* extends forwardly substantially from the mid-length point and is tapered towards its forward end which is substantially in transverse alignment with the forward ends of the two hull structures 12.

As best seen in FIG. 4, the hull structures are connected with the main frame structure 38 by means of a forward-frame structure 40, a mid-frame structure 42 and an aft-frame structure 44. Each of the frame structures are similar in construction, and it is believed that it will only be necessary to describe one such structure in detail. For example, the forward-frame structure comprises similar transversely aligned sections 40*a* and 40*b* which are similarly constructed and are similarly attached to the envelope of the associated hull structure. For example, the section 40*b* is of tubular construction and has an inner end which is received endwise into the open end of a tubular socket member 46, the opposite end of which is rigidly secured to the body of the main frame 38. This end of the section may be releasably retained in the socket by means of a retaining bolt 47 which passes through aligned openings in the socket and the associated end of the section and is threadedly engaged by a wing nut 48.

The outer end of the section, in this case the section 40*b*, is downwardly curved and connected with a tab 50 by means of a flexible tie or lacing 52. The tab 50 is bonded or otherwise secured to the outer side of the envelope 14. On the opposite side of the envelope, the section is connected by means of a looped band 54 which has its lowermost end bonded or otherwise secured to this side of the envelope, while the uppermost end is looped over the tubular section. With this arrangement, the section is readily assembled and disassembled with respect to the main frame and the connected envelope.

A flexible deck surface is provided between the mid-frame 42 and the aft-frame 44. For this purpose, a strip 56 of canvas or other suitable material is stretched over the underlying main frame 38 and the envelopes of the respective hull, provision being made for securing the respective ends of the strip to the adjacent envelope by means of lacing 58 passing through appropriate openings in the end of the strip and openings formed in an attaching tab or flap 60 secured to the associated side of the envelope.

At the forward ends of the envelopes, the tube sections 20*a* are formed with laterally extending end portions 20*c* which are releasably secured to the forward end of the main frame 38 by socket members 46 in the same manner as previously described for the bridging sections.

Although not shown, it is within the scope of the present invention that the main frame 38 may embody a centerboard structure, if desired. The main frame carries a mast 62 and operatively associated boom 64 which are supportingly connected with a main sail 66. The lowermost end of the mast is removably stepped in a socket 68 formed in the main frame 38 at a position forwardly of the mid-frame structure 42. The mast is detachably retained in its operative position by standing rigging which comprises a fore-stay 70 having its lowermost end releasably connected with the forward end portion of the main frame 38, as indicated by the numeral 72. A pair of lateral-stays 74 and 76 have their lowermost ends releasably connected to the outermost ends of the mid-frame structure 42 as indicated at 78 in each case. A jib sail 80 has its leading edge slidably connected with the fore-stay 70. The main sail 66 is controlled by means of a main sheet 82 connected between the boom and the aft-frame structure 44. A rudder 84 of conventional construction is removably supported at the aft-end of the main frame 38 by means of appropriate hinge pintles 86.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. A knockdown boat structure, comprising:

(a) at least one hull structure formed by an elongate relatively low pressure inflatable envelope of a pliable fabric material;

(b) said envelope being tapered from substantially its mid-length towards generally pointed opposite ends;

(c) a built-in tubular elongate surface sleeve portion extending generally between the ends of said envelope;

(d) elongate rigid reinforcing means extending lengthwise within said sleeve, comprising an elongated light weight tubular member;

(e) a longitudinally rigid non-inflatable frame member extending in generally parallel laterally offset relation to said envelope;

(f) fore, mid and aft bridging members independently connecting said envelope and said frame member;

(g) means detachably connecting said bridging members to said envelope independently of said tubular member.

2. A boat structure according to claim 1, in which a pair of said envelopes are interconnected by bridging frames in spaced relation with a main central elongate rigid frame structure to provide a catamaran hull structure, said central frame structure having a generally cylindrical transverse section and being inwardly spaced on its opposite sides respectively from said envelopes.

3. A boat structure according to claim 2, in which the central frame structure is of fiberglass, and tapered to provide a substantially pointed forward end.

4. A boat structure according to claim 2, including a mast removably stepped in said central frame structure; and rudder means removably supported at the aft end of said central frame structure.

5. A boat structure according to claim 2, in which said bridging frames comprise a forward frame, mid-frame and aft-frame; and in which each of said frames comprises a pair of releasably interconnected sections respectively connecting each of said envelopes with said central frame.

6. A boat construction according to claim 5, in which a mast is removably stepped in said central frame structure, forwardly of said mid-frame; a fore-stay from the top of the mast is releasably connected with the forward end of said central frame; and lateral stays from the top of the mast are respectively releasably connected with the outer ends of said mid-frame.

7. A boat structure according to claim 5, in which a strip of flexible fabric positioned between the mid-frame and aft-frame overlies portions of said envelopes and central frame to provide a deck; and means for releasably connecting the respective ends of said strip with the outer sides of the respective envelopes to provide a deck area.

8. A boat structure according to claim 1, in which the tubular sleeve and associated tubular members extend along the bottom of the envelope.

9. A boat structure according to claim 8, wherein the end taper of the inflated envelope is curved; and said tubular members are respectively curved between their ends to conform to said curved taper.

10. A knockdown boat structure, comprising:

(a) at least one hull structure formed by an elongate relatively low pressure inflatable envelope of a pliable fabric material;

(b) said envelope being tapered from substantially its mid-length towards generally pointed opposite ends;

(c) a built-in tubular elongate surface sleeve portion extending generally between the ends of said envelope;

(d) elongate rigid reinforcing means extending lengthwise within said sleeve, comprising an elongated light weight tubular member;

(e) a longitudinally rigid non-inflatable frame member extending in generally parallel laterally offset relation to said hull structure;

(f) fore and aft bridging members independently connecting said hull structure and said frame member, said bridging members having curved ends; and (g) means detachably connecting said bridging members to said hull structure including radially curved peripheral arcuate surface sleeves on said inflatable envelope to respectively receive the curved ends of said bridging members and fixedly anchor said ends to said envelope, when the envelope is inflated.

11. A knockdown boat structure, comprising:

(a) a hull structure formed by a pair of elongate relatively low pressure inflatable envelopes of a pliable fabric material;

(b) each of said envelopes being tapered from substantially its mid-length towards generally pointed opposite ends;

(c) a built-in tubular elongate surface sleeve portion extending generally between the ends of the envelope;

(d) elongate rigid reinforcing means extending lengthwise within said sleeve, comprising an elongated light weight tubular member;

(e) a longitudinally rigid non-inflatable central frame structure extending in generally parallel laterally offset relation between said envelopes and having a generally cylindrical transverse section, and being inwardly spaced from said envelopes;

(f) bridging frames independently connecting said envelopes and said central frame structure to provide a catamaran hull structure, said bridging frames comprising a forward frame, mid-frame and aft-frame, each of said frames comprising a pair of releasably interconnected sections including a tubular member for respectively connecting each of said envelopes with said central frame structure;

(g) means detachably connecting said bridging frames to said central frame structure, including socket means on said central frame structure for releasably receiving an inner end of said tubular member; and (h) means for releasably anchoring the outer end of said tubular member at opposite sides of said associated envelope.

12. A boat structure according to claim 11, in which the outer end of each tubular member is downwardly curved and provided with openings for a tie-lacing connection with openings in a tab member secured to an outer side of the envelope; and in which a looped band secured to an inner side of the envelope is adapted to releasably receive the outer end portion of the tubular member therethrough.

13. A knockdown boat structure, comprising:

(a) a hull structure formed by a pair of elongate relatively low pressure inflatable envelopes of a pliable fabric material;

(b) each of said envelopes being tapered from substantially its mid-length towards generally pointed opposite ends;

(c) a built-in tubular elongate surface sleeve portion extending generally between the ends of the envelope;

(d) elongate rigid reinforcing means extending lengthwise within said sleeve, comprising an elongated light weight tubular member;

(e) a longitudinally rigid non-inflatable central frame structure extending in generally parallel laterally offset relation between said envelopes and having a generally cylindrical transverse section, and being inwardly spaced from said envelopes;

(f) bridging frames independently connecting said envelopes and said central frame structure to provide a catamaran hull structure, said bridging frames comprising a forward frame, mid-frame and aft-frame, each of said frames comprising a pair of releasably interconnected sections respectively connecting each of said envelopes with said central frame structure;

(g) means detachably connecting said bridging frames to said central frame structure;

(h) a strip of flexible fabric positioned between the mid-frame and aft-frame overlying portions of said envelopes and central frame; and (i) means for releasably connecting the respective ends of said strip with the outer sides of the respective envelopes to provide a deck area, including longitudinally extending lacing tabs respectively formed at the outer sides of the envelopes for releasable connection by means of a tie member with the associated end of said fabric strip.

14. A knockdown boat structure, comprising:

(a) a hull structure formed by a pair of elongate relatively low pressure inflatable envelopes of a pliable fabric material;

(b) each of said envelopes being tapered from substantially its mid-length towards generally pointed opposite ends;

(c) a built-in tubular elongate surface sleeve portion extending generally between the ends of the envelope;

(d) elongate rigid reinforcing means extending lengthwise within said sleeve, comprising an elongated light weight tubular member;

(e) a longitudinally rigid non-inflatable central frame structure extending in generally parallel laterally offset relation between said envelopes and having a generally cylindrical transverse section, and being inwardly spaced from said envelopes;

(f) bridging frames independently connecting said envelopes and said central frame structure;

(g) means detachably connecting said bridging frames to said central frame structure; and (h) said elongate reinforcing means of each envelope at its forward end being releasably interconnected with the forward end of said central frame structure.

15. A boat construction according to claim 14, in which the tubular member of each reinforcing means for each envelope has an angularly directed end portion extending towards the central frame; and socket means at the forward end of said central frame structure releasably receives the respective end portions.

16. A knockdown boat structure, comprising:

(a) at least one hull structure formed by an elongate relatively low pressure inflatable envelope of a pliable fabric material;

(b) said envelope being tapered from substantially its mid-length towards generally pointed opposite ends;

(c) a built-in tubular elongate surface sleeve portion extending generally between the ends of said envelope;

(d) elongate rigid reinforcing means extending lengthwise within said sleeve, comprising an elongated light weight tubular member;

(e) a longitudinally rigid non-inflatable frame member extending in generally parallel laterally offset relation to said hull structure;

(f) fore and aft bridging members independently connecting said hull structure and said frame member; and (g) means detachably connecting said bridging members to said hull structure in which the end of each of said bridging members that is connected to said hull structure is downwardly curved and provided with openings for a tie-lacing connection with openings in a tab member secured to an outer side of the envelope, and a looped band secured to an inner side of the envelope is adapted to releasably receive the connected end of the bridging member therethrough.

17. A knockdown boat structure, comprising:

(a) at least one hull structure formed by an elongate relatively low pressure inflatable envelope of a pliable fabric material and having a forward end;

(b) said envelope being tapered from substantially its mid-length towards generally pointed opposite ends;

(c) a built-in tubular elongate surface sleeve portion extending generally between the ends of said envelope;

(d) elongate rigid reinforcing means extending lengthwise within said sleeve, comprising an elongated light weight two-piece tubular member;

(e) a longitudinally rigid non-inflatable frame member extending in generally parallel laterally offset relation to said envelope and having a forward end;

(f) fore, mid and aft bridging members independently connecting said envelope and said frame member;

(g) means connecting the forward end of said envelope to the forward end of said frame member;

(h) means detachably connecting said bridging members to said envelope; and (i) in which the two pieces of said tubular member have inner meeting ends adjacent the connection of the mid bridging member to said envelope.

* * * * *